US006142857A

United States Patent [19]

Cesna

[11] Patent Number: 6,142,857

[45] Date of Patent: Nov. 7, 2000

[54] WAFER POLISHING WITH IMPROVED BACKING ARRANGEMENT

[75] Inventor: Joseph V. Cesna, Niles, Ill.

[73] Assignee: Speedfam-IPEC Corporation, Chandler, Ariz.

[21] Appl. No.: 09/079,729

[22] Filed: May 15, 1998

Related U.S. Application Data

[63] Continuation-in-part of application No. 09/003,346, Jan. 6, 1998, Pat. No. 5,972,162.

[51] Int. Cl.[7] ..... B24B 29/00

[52] U.S. Cl. ..... 451/287; 451/398; 451/288; 451/287; 451/41

[58] Field of Search ..... 451/397, 398, 451/288, 287, 285, 41, 8

[56] References Cited

U.S. PATENT DOCUMENTS

| | | | |
|---|---|---|---|
| 3,842,544 | 10/1974 | Paola | 51/129 |
| 4,410,168 | 10/1983 | Gotman | 269/21 |
| 4,519,168 | 5/1985 | Cesna | 51/216 |
| 4,521,995 | 6/1985 | Sekiya | 51/235 |
| 4,625,463 | 12/1986 | Sekiya | 51/216 |
| 4,918,869 | 4/1990 | Kitta . | |
| 5,193,316 | 3/1993 | Olmstead | 51/281 |
| 5,205,082 | 4/1993 | Shendon et al. | 51/283 |
| 5,230,184 | 7/1993 | Bukhman | 51/283 |
| 5,423,558 | 6/1995 | Koeth et al. | 279/3 |
| 5,423,716 | 6/1995 | Strasbaugh | 451/388 |
| 5,441,444 | 8/1995 | Nakajima | 451/289 |
| 5,449,316 | 9/1995 | Strasbaugh | 451/289 |
| 5,542,874 | 8/1996 | Chikaki | 451/158 |
| 5,558,563 | 9/1996 | Cote et al. | 451/41 |
| 5,584,746 | 12/1996 | Tanaka et al. | 451/41 |
| 5,584,751 | 12/1996 | Kobayashi et al. | 451/288 |
| 5,588,902 | 12/1996 | Tominaga et al. | 451/288 |
| 5,605,488 | 2/1997 | Ohashi et al. | 451/7 |
| 5,618,227 | 4/1997 | Tsutsumi et al. | 451/288 |
| 5,624,299 | 4/1997 | Shendon | 451/28 |
| 5,635,083 | 6/1997 | Breivogel et al. | 216/88 |
| 5,643,053 | 7/1997 | Shendon | 451/28 |
| 5,643,061 | 7/1997 | Jackson et al. | 451/289 |
| 5,645,474 | 7/1997 | Kubo et al. | 451/287 |
| 5,651,724 | 7/1997 | Kimura et al. | 451/41 |
| 5,762,539 | 6/1998 | Nakashiba et al. | 451/41 |

FOREIGN PATENT DOCUMENTS

| | | |
|---|---|---|
| 0 737 546 A2 | 10/1996 | European Pat. Off. . |
| 0 747 167 A3 | 1/1997 | European Pat. Off. . |
| 0 776 370 A1 | 6/1997 | European Pat. Off. . |
| 221307 | 4/1985 | Germany . |
| 7-67665 | 7/1995 | Japan . |
| WO 96/24467 | 8/1996 | WIPO . |

OTHER PUBLICATIONS

PCT Search Report for Application No. PCT/US99/05906.

Murakami et al., "Long Run Planarity and Uniformity Performance of CMP on Single Hard Pad With Air—Backed Carrier and In–Situ Pad Profile Control", Jun. 18–20, 1996 VMC Conerence, pp. 413–418.

Hayashi et al., "Ultrauniform Chemical Mechanical Polishing (CMP) Using A 'Hydro–Chuck' , Featured By Wafer Mounting On A Quartz Glass Plate With fully Flat, Water Supported Surface", Jpn. J. Appl. Phys. vol. 35 (1996), pp. 1054–1059, Part 1, No. 28, Feb. 1996.

*Primary Examiner*—Timothy V. Eley
*Assistant Examiner*—Willie Berry, Jr.
*Attorney, Agent, or Firm*—Fitch, Even, Tabin & Flannery

[57] ABSTRACT

A wafer carrier includes a porous media layer through which a pressurized fluid is injected. The porous media layer introduces lateral dispersion into the pressurized flow, thereby assuring a uniform pressure at the exit surface of the porous media layer, as when the porous media layer is located adjacent the wafer being polished. Alternatively, an inflatable bladder may be introduced between the porous media layer and the wafer, again with pressure being maintained uniform by the porous media layer.

17 Claims, 10 Drawing Sheets

WAFER POLISHING WITH IMPROVED BACKING ARRANGEMENT

This is a continuation-in-part of U.S. patent application Ser. No. 09/003,346 filed Jan. 6, 1998, now U.S. Pat. No. 5,972,162.

BACKGROUND OF THE INVENTION

1. Field of the Invention

The present invention pertains to wafer polishing, and especially to the planarization of semiconductor wafers and the like thin, flat workpieces.

2. Description of the Related Art

As is known in the art, many types of semiconductor devices are made by stacking multiple thin layers one on top of the other using metalization, sputtering, ion implantation and other techniques. The thicknesses of such layers are very small, typically on the order of several molecular dimensions. These techniques allow integrated circuits to be made up of multiple millions of circuit devices which are typically formed in a semiconductor substrate which is relatively thin and therefore fragile. For example, commercial semiconductor wafers may have a diameter of six or eight inches, having a thickness on the order of several thousandths of an inch or less. In practical production, the flatness of such wafers is typically held to 120 micro inches or less. As is known in the art, flatness or global planarity is achieved by abrading the wafer surface so as to remove high spots. However, it must be borne in mind that the coatings applied to the wafer may be as thin as 30 micro inches, held to an accuracy (or variation in thickness) of roughly 1/100 of the thickness of the coating. As is apparent from the above considerations, great care must be taken in polishing a semiconductor wafer.

The SpeedFam Corporation of Chandler, Ariz., assignee of the present invention, is a manufacturer of equipment for planarizing wafers using chemical/mechanical polishing (CMP) and other techniques. In polishing wafers, typically of semiconductor material such as silicon, the wafer is placed face down on a polish pad carried on a rotating, driven table. A chemically active media, frequently referred to as a "slurry" and oftentimes containing abrasive particles, is introduced between the wafer and the polishing pad. A polishing force is applied to the back side of the wafer, pressing the wafer against the polish pad. Polishing force is typically applied by a relatively massive polish head, with a backing pad interposed between the polish head and the back side of the wafer.

During the polishing process, portions of the wafer surface protruding from a theoretical truly flat plane are removed, with resulting wafer particles being suspended in the slurry. The material removal rate during polishing depends on a number of factors, the primary factor being the down force applied to the wafer, pressing the wafer against the polish pad. As has been observed over the years, careful controlling of the down force over the entire surface of the wafer is important if global planarity is to be achieved with an acceptable amount of material removal.

As mentioned, the wafers being polished are relatively thin and, depending upon their physical composition and the composition and proportion of layers deposited therein, have varying degrees of stiffness. Even with the stiffer wafer compositions, it is oftentimes possible with close scrutiny to observe variations in the backing pad or pressure head to "print through" or otherwise be reflected in the surface of the wafer being polished. While articulated backing arrangements such as those described in U.S. Pat. Nos. 5,441,444, 5,584,746 and 5,651,724 provide advances in providing enhanced control of down forces throughout the entire wafer surface, the risk of print-through is substantially increased.

The assignee of the present invention has provided significant advances in improving backing pad flatness, using a number of pre-operational techniques to "dress" the active backing pad surface. Cost control measures are being applied throughout the entire semiconductor device production, and backing pads are being scrutinized on a cost basis as consumable goods requiring substantial cost outlays in material and labor. As mentioned above, particles removed from a semiconductor surface are suspended in the slurry surrounding the wafer being polished. Such particles inevitably migrate between the back side of the wafer and the backing pad, becoming embedded in the backing pad surface. To a certain extent, backing pads exhibit a limited resilience which is altered in a non-controlled, non-uniform manner throughout the life of the backing pad. Particle embedding and other forces operate to create localized "hard spots" in the surface of the backing pad and over repeated polishing operations, deterioration of the backing pad becomes increasingly aggravated, eventually requiring replacement of the backing pad.

Typically, backing pads are secured to the pressure plate with a pressure sensitive adhesive. Removal of a used backing pad, therefore, requires removal of its associated sealing layer from the surface of the pressure plate so that the highly controlled flatness of the pressure plate surface can be fully restored in preparation for the installation of a new backing pad. A new sealing layer must thereafter be applied to the pressure plate surface with sufficient exactness so as to avoid destroying the carefully controlled flatness or "global planarity" of the pressure plate and working surface of the new backing pad. While various techniques are available to "dress" the backing pad surface after its installation so as to account for irregularities in adhesive thickness, the ability to correct such flatness excursions is limited.

Accordingly, attention has been directed to the possibility of replacing backing pad systems with an alternative system offering cost advantages. Several of the patents referred to above attempt to replace conventional backing pads with a flexible sheet or other bladder construction pressurized by a fluid, such as water, or gas, such as air. Various arrangements have been proposed for use in wafer planarization in which a single bladder is made to cover substantially the entire wafer back surface. Examples of such arrangements are found in U.S. Pat. Nos. 5,449,316 and 5,635,083. Despite such efforts, backing pad assemblies continue to dominate the semiconductor wafer polishing industry as the preferred mode for supporting the wafer during chemical/mechanical polishing. Other arrangements in which the flexible membrane or bladder is provided with non-uniform resilient characteristics such as proposed in U.S. Pat. No. 5,624,299 have been considered in an attempt to improve the performance of the overall system.

Typically, semiconductor wafers are polished many times during the course of semiconductor device fabrication. As multiple layers of conductors and dielectrics are built up on the surface of a wafer, polishing is usually required after the deposition of each layer to restore any deviation from highly demanding local and global flatness tolerances. Because so-called "out-of-flatness" tolerances must be related to the total, finished construction, it is critical that the polishing process be held to extremely close tolerances such that finished densely packed structures do not interfere with one another.

It is important, during the course of preparing the semiconductor surface, that proper amounts of polishing are applied to assure that the desired degree of flatness is attained without undesirable intrusion into the deposited layers, which might compromise their intended electronic operation. While it is possible to periodically remove the wafer being processed from the polishing apparatus in order to inspect the wafer surface, such practices are undesirable in that they subject the wafer to additional handling with an attendant risk of injury. Further, the environmental condition of the wafer must be taken into account. For example, wafers being processed are oftentimes maintained immersed in an aqueous environment. In order to facilitate remote inspection of the wafer, the wafer would have to be removed from the aqueous environment, cleaned, and dried to facilitate inspection. Care must be taken to guard against distortion of the wafer, and the introduction of wet/dry cycles may give rise to unwanted distortion and may introduce harmful contamination.

In order to overcome these drawbacks, attention has been directed to so-called in-situ end point detection. A variety of techniques have been developed over the years. For example, various electrical signals have been passed through the wafer and the area of polishing activity, with the electrical signal thereby being modified in a certain manner, dependent upon the amount of polishing of the wafer surface. In general, such techniques rely upon an indirect detection of the wafer surface characteristics. Correlation of various modifications of the electrical signal to the wafer surface characteristics typically requires considerable experience and intense research for each particular process being carried out. Changes in polishing conditions (for example changes in slurry composition, abrasive structures, polish wheel compositions and the like) oftentimes require additional study with new correlation techniques being developed in order to indirectly indicate the surface condition of the wafer being processed in an accurate manner.

The outer edges of semiconductor wafers have been monitored on a real-time basis. Wafers mounted on reciprocating arms are carried to the edge of a polishing table, and slightly beyond by the reciprocating action. Thus, for a brief instant with each cycle of reciprocation, the bottom surface of the wafer is exposed to a monitoring probe located immediately adjacent the edge of the polishing wheel. However, only a relatively minor outer portion of the wafer can be exposed in this manner if damage and/or unwanted wafer surface patterns are to be avoided. A more convenient and complete monitoring of the wafer is being sought.

SUMMARY OF THE INVENTION

It is an object of the present invention to provide wafer carriers which give "contactless" pressurized fluid support for an object being polished.

Another object of the present invention is to provide polishing apparatus of the above-described type for planarizing flat workpieces such as semiconductor wafers.

A further object of the present invention is to provide polishing apparatus for use with the above-described wafer carrier, giving improved end point detection.

Yet another object of the present invention is to provide a polishing tool having a pneumatic pressure head with improved pressure balancing.

Yet another object of the present invention to provide in-situ monitoring of wafer surface characteristics during a polishing operation.

Another object of the present invention is to provide in-situ direct observation of interior portions of the wafer surface, and not only the radially outer portions of the wafer surface.

These and other objects of the present invention which will become apparent from studying the appended description and drawings are provided in a wafer carrier for polishing a surface of a semiconductor wafer, comprising:

a backing plate defining a recess;

a pressure balance assembly including a porous media layer having a side wall extending between spaced-apart front and back opposed major surfaces;

a fluid-impermeable sealant layer on said back surface;

a plurality of holes communicating with said recess, defined by said pressure balance assembly extending through said fluid-impermeable sealant layer, past said back surface of said porous media layer, so as to extend toward said front major surface of said porous media layer; and fluid coupling means coupling an external fluid source to said plurality of said holes, which introduce said fluid into interior portions of said porous media layer with said porous media layer laterally dispersing fluid through said holes in directions non-normal to said front surface.

Other objects of the present invention are provided in an arrangement for monitoring a surface of a semiconductor wafer, comprising an arrangement for polishing a surface of a semiconductor wafer, comprising:

a support table having a central axis and an upper, support surface for engaging the surface of the semiconductor wafer to provide support for the semiconductor wafer;

an annular recess defined by the support table, extending to the support surface so as to form an opening therein, between two annular support surface portions;

a polish pad covering the support surface of the support table;

a monitoring probe disposed in the recess and having a free end portion adjacent the semiconductor wafer to monitor the semiconductor wafer surface without interfering with the semiconductor wafer surface;

a support arm;

A wafer carrier carried on said support arm for pressing the semiconductor wafer surface against the polish pad;

said wafer carrier including a wafer carrier for polishing a surface of a semiconductor wafer, comprising a backing plate defining a recess, a pressure balance assembly including a porous media layer having a side wall extending between spaced-apart front and back opposed major surfaces, a fluid-impermeable sealant layer on said back surface, a plurality of holes communicating with said recess, defined by said pressure balance assembly extending through said fluid-impermeable sealant layer, past said back surface of said porous media layer, so as to extend toward said front major surface of said porous media layer, and fluid coupling means coupling an external fluid source to said plurality of said holes, which introduce said fluid into interior portions of said porous media layer with said porous media layer laterally dispersing fluid through said holes in directions non-normal to said front surface; and table rotating means for rotating the support table about the central axis, with the monitoring probe supported against rotation with the table.

DETAILED DESCRIPTION OF THE PREFERRED EMBODIMENTS

Figure 1:
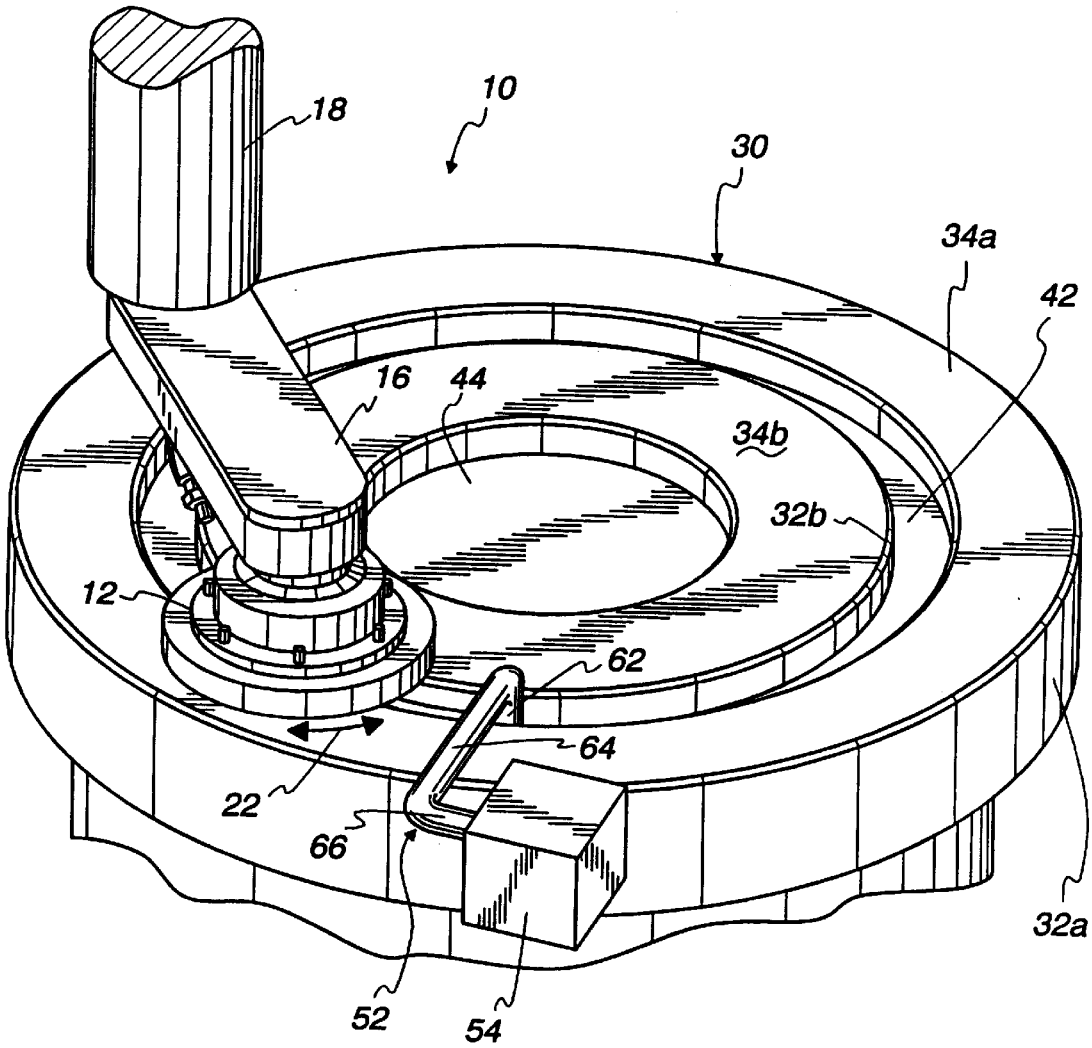
FIG. 1 is a fragmentary perspective view of an end point detection apparatus according to principles of the present invention.
Figure 2:
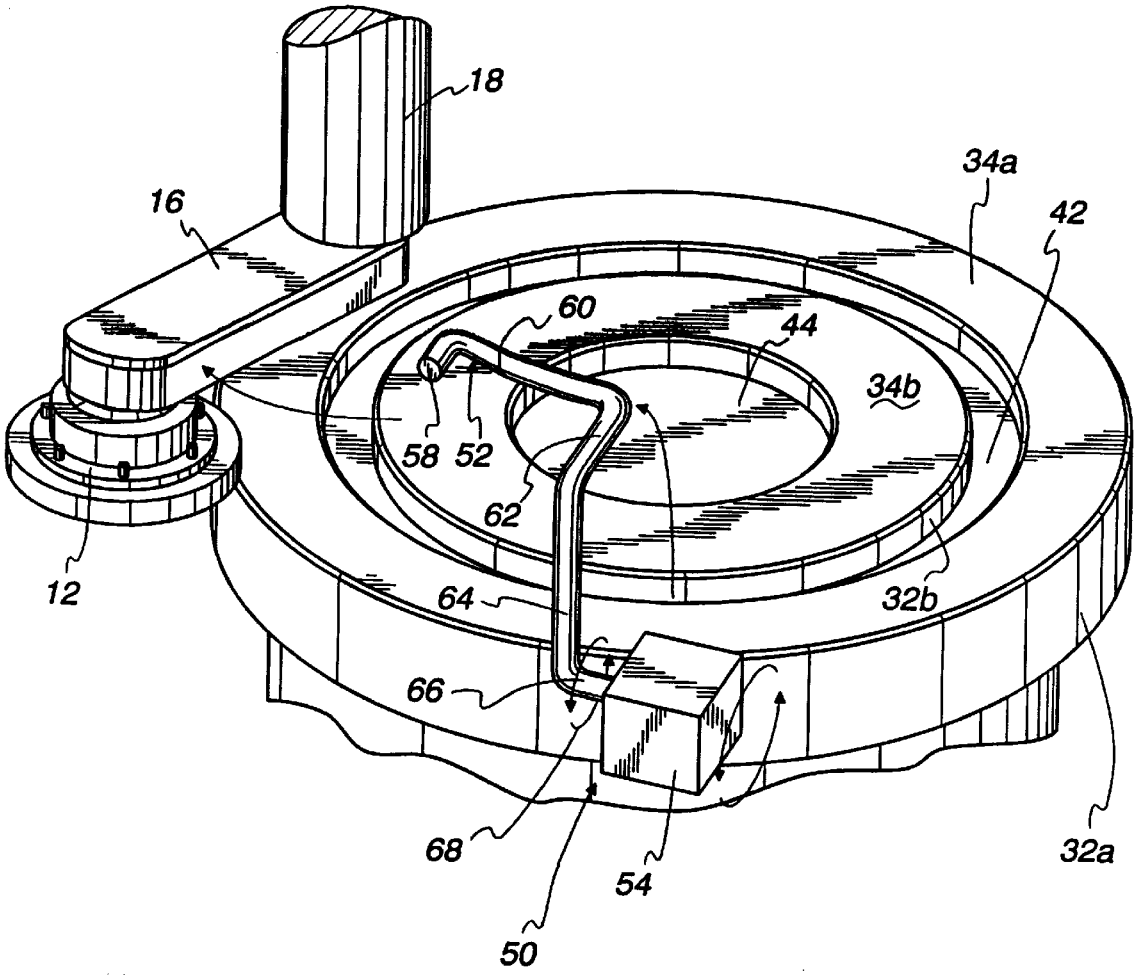
FIG. 2 is a fragmentary perspective view similar to that of FIG. 1, but showing the detection probe in a retracted position.
Figure 3:
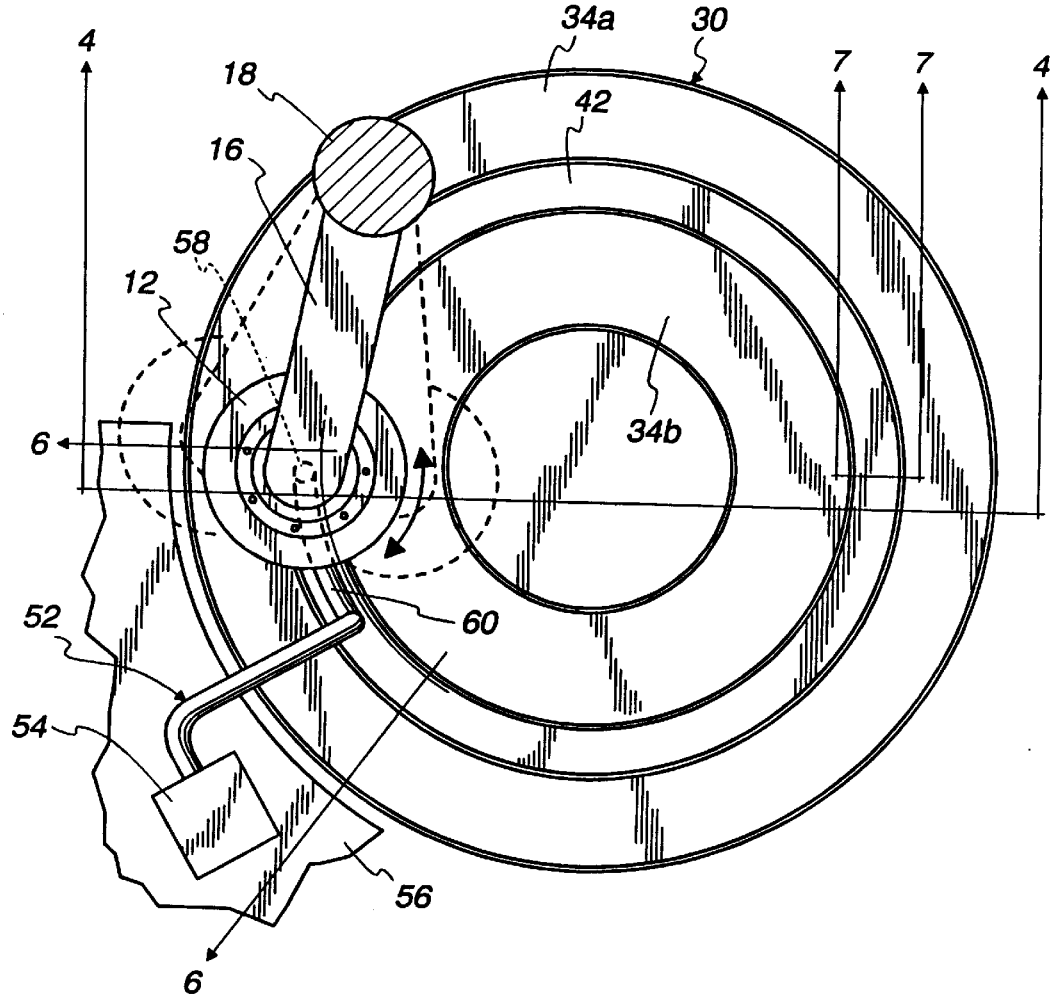
FIG. 3 is a top plan view of the arrangement of FIG. 1.

Referring now to the drawings, and initially FIGS. 1–5, wafer polish apparatus is generally indicated at 10. Included is a novel wafer carrier or chuck 12 for polishing a semiconductor wafer 80. Wafer carrier 12 is supported at one end of a reciprocating arm 16 which pivots about the central axis of a drive member 18. In a known manner, the support arm 16 reciprocates back and forth sweeping out an arcuate path, as indicated in FIG. 3. Extreme positions of the support arm 16 and wafer carrier 12 are shown exaggerated in FIG. 3 for purposes of illustration. It is generally preferred that the wafer carrier 12 be fully supported at all times (without overhand such as that shown in dotted lines in FIG. 3). Wafer carrier 12 is preferably driven for rotation about its central axis so as to rotate in the direction of arrow 22 shown in FIG. 1.

In addition to imparting a reciprocating motion to the wafer carrier, support element 18 also applies a carefully controlled downward pressure on the wafer located within carrier 12. If desired, the support element 18 and arm 16 can be replaced by the arrangement shown in commonly assigned U.S. Pat. No. 5,329,732, the disclosure of which is incorporated by reference as if fully set forth herein. In U.S. Pat. No. 5,329,732 the wafer carrier 12 is supported from above by mechanism which imparts a reciprocating motion of the kind indicated in FIG. 3.

Referring again to FIGS. 1–5, a polish wheel assembly is generally indicated at 30. Polish wheel assembly 30 includes an underlying, supporting, polish wheel 32 having an upper, support surface 33 (see FIG. 7) to which a layer of suitable polish pad material 34 has been affixed by conventional means, such as pressure sensitive adhesive. According to one aspect of the present invention, the upper surface of polish table 32 is divided into two parts, 32*a* and 32*b*, by an annular groove 42. Preferably, polish table 32 has a hollow center 44 and, accordingly, recess 42 forms two nested, concentric, spaced-apart annular surface portions in the polish wheel. The outer annular surface portion of the polish wheel is covered with an annular polish pad section 34*a*, while the inner polish wheel portion 32*b* has its upper surface covered with an annular polish pad section 34*b*.

Figure 4:
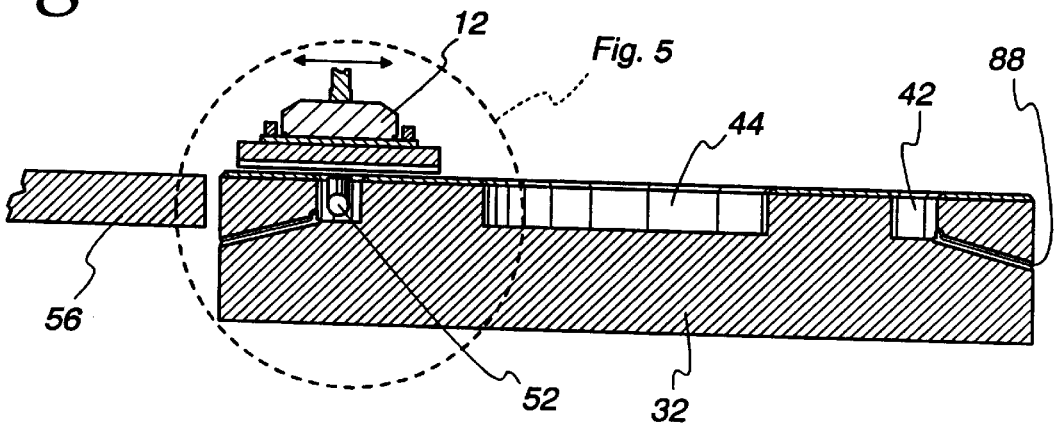
FIG. 4 is a fragmentary cross-sectional view taken along the line 4—4 of FIG. 3.
Figure 5:
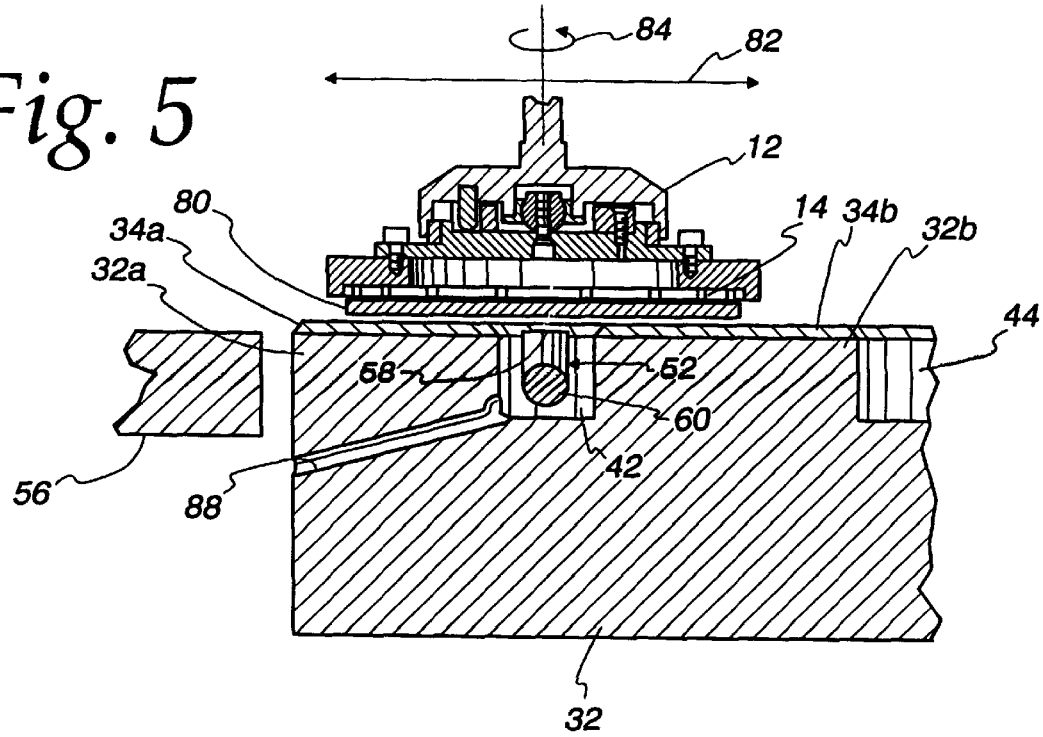
FIG. 5 shows an enlarged portion of FIG. 4.

Referring now to FIG. 2, a probe assembly is generally indicated at 50 and includes a probe 52 and a controller 54 mounted to one side of the polish wheel assembly. As can be seen in FIGS. 3–5, for example, controller 54 is mounted on a table 56 located adjacent the polish wheel. Probe 52 has a free end 58 which is upturned away from a generally arcuate portion 60. An upstanding portion 62 rises out of recess 42 as can be seen in FIG. 1, allowing the probe end 64 to extend above the surface of the polish wheel, as can be seen in FIG. 1. Probe 52 is supported in cantilever fashion from controller 54 and is mounted for rotation along the central axis of stub end portion 66, in the direction of the arrows 68, as shown in FIG. 2. Preferably, arcuate portion 60 of probe 52 is made slightly larger than the radius of carrier 12 so as to allow the upright portion to clear the polishing wheel. The probe 52 preferably is constructed so as to retain its desired shape in a self-supporting manner. The outer sheaf of the probe cable can, if desired, be made sufficiently rigid for this purpose. Alternatively, the probe and/or probe cable can be fitted within an outer supporting conduit.

Figure 6:
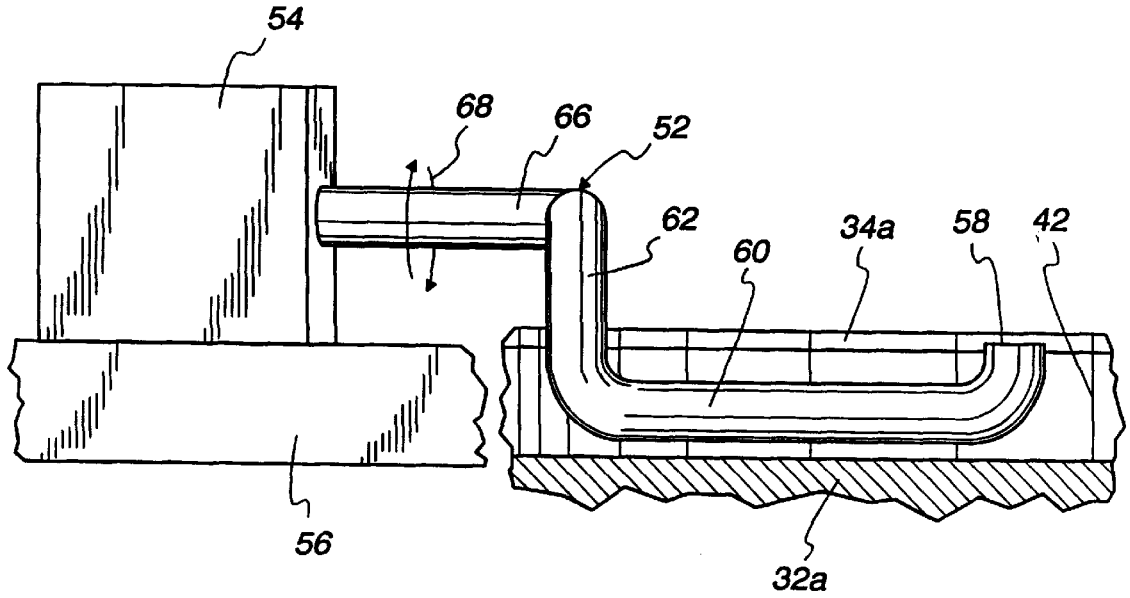
FIG. 6 is a fragmentary cross-sectional view taken along the line 6—6 of FIG. 3.

In FIG. 1, probe 52 is rotated in a downward direction such that the arcuate portion 60 and free end 58 are received within recess 42, as shown in FIG. 6. With probe 52 rotated in the opposite direction by controller 54, the probe is raised out of recess 42 so as to allow maintenance operations to be performed on the polish wheel.

Figure 18:
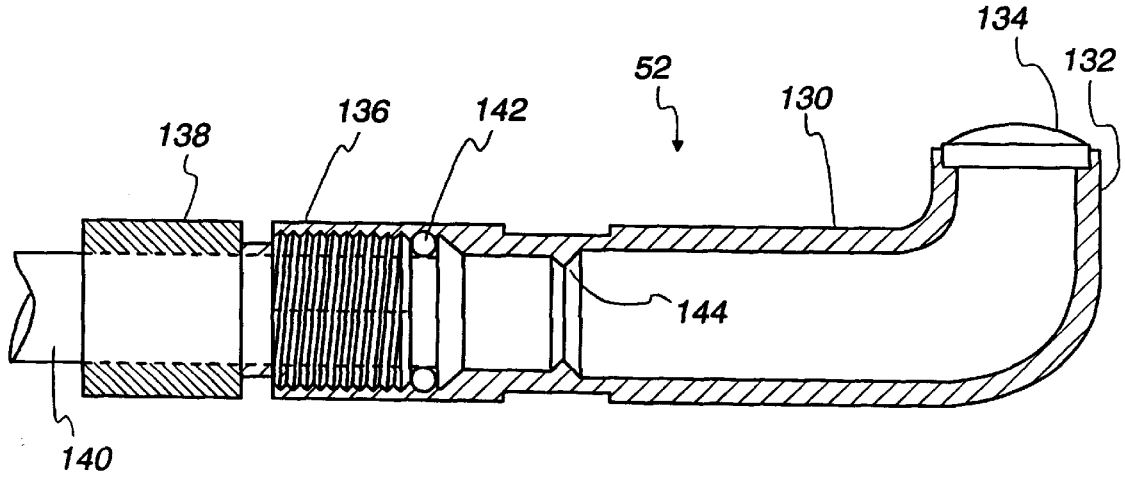
FIG. 18 is a cross-sectional view of a probe member used with the end point detection apparatus.

The internal construction within probe 52 is of conventional design. Referring to FIG. 18, the probe 52 includes a feral or lens housing 130, preferably formed of a 316 stainless steel and having a forward or open end 132 for receiving a conventional optical lens (such as Part No. A31,854 (available from Edmund Scientific Company of Barrington, N.J.). Lens housing 130 includes a second end 134 which is threaded to receive a nut 138 used to secure a conventional optical cable 140. Preferably, the nut 138 includes external threads received within the threaded hollow end 136 of housing 130. The nut 138 is preferably sealed to housing 130 with a VITON o-ring 142. As an optional feature, housing 130 includes an internal annular restriction 144, preferably having a cross-sectional angle of approximately 90 degrees and having an internal free end terminating in a radius of 0.2 millimeter, so as to form an internal diameter of approximately 7 millimeters. The lens 134 is installed within housing 130 in a fluid-type arrangement, using a suitable adhesive. The cable 140 has a free end prepared in a conventional manner, which is thereafter inserted within housing 130, preferably in a nitrogen-filled environment. Nut 138 and o-ring 132 are then applied to seal the nitrogen-filled interior of housing 130, to prevent undesirable fogging of lens 134. In the preferred embodiment, the free end 58 of probe 52 has optical monitoring capability for direct observation of a wafer being polished. If desired, the probe may include a conventional air jet means (not shown) for keeping the face of free end 58 clean and free of slurry so as to allow continuous, uninterrupted monitoring.

As indicated in FIG. 3, the free end 58 of probe 52 is located adjacent the exposed surface of a wafer held in carrier 12. As the carrier is reciprocated back and forth, and rotated about the central axis of carrier 12, the probe 52 is made to observe the entire surface of the semiconductor wafer, on an ongoing real-time basis, without interfering with the polishing operation.

Figure 7:
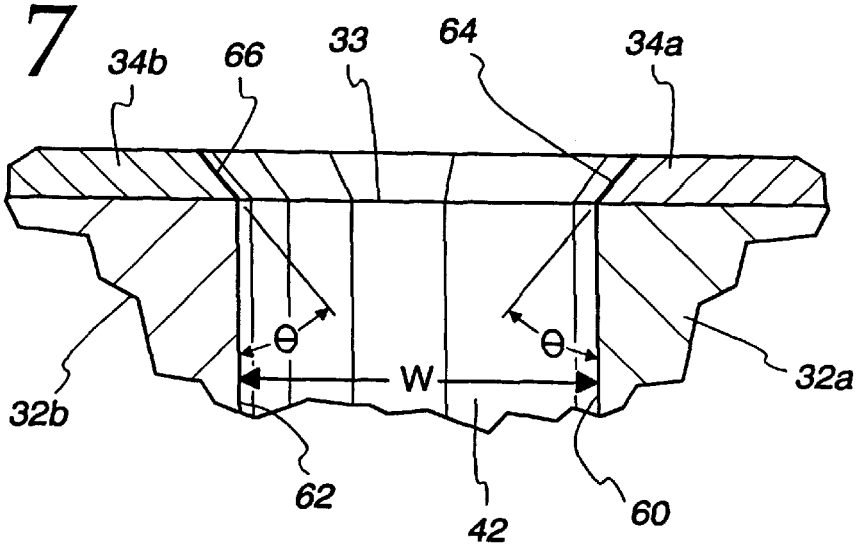
FIG. 7 is a fragmentary cross-sectional view, on an enlarged scale, taken along the line 7—7 of FIG. 3.

Referring to FIG. 7, as mentioned above, the upper surface of annular polish wheel portions 32*a*, 32*b* are covered with respective annular portions 34*a*, 34*b* of polish pad material. In the preferred embodiment, as mentioned, the polish pad material is secured to the polish wheel with a suitable contact adhesive. Preferably, installation of the polish pad material is accomplished by covering both inner and outer annular portions of the polish wheel with a single, unitary polish pad. Initially, the polish pad material spans the recess 42, and is trimmed away from the recess by a knife blade or other cutting instrument.

Referring again to FIG. 7, annular polish wheel portions 32*a*, 32*b* have opposed vertical faces 60, 62. The relative dimensions of recess 42 are shown exaggerated in the drawings, for clarity of illustration. It is preferred that the lateral width W of recess 42 range between 2% and 6% of the outer radius of the polish wheel. Most preferably, the lateral width W of recess 42 ranges between 2% and 4% of the polish wheel radius.

If desired, the polish pad material could be trimmed substantially parallel to the wall faces 60, 62. However, in operation, the polish pad material is compressed by pressure applied to carrier 12, pressing the semiconductor wafer against the polish pad material. Depending on the type of polish pad material and the amount of pressure applied, it is possible that the polish pad material would "grow", extending beyond wall faces 60, 62. In certain types of polishing operations, this may result in unwanted surface pattern formations. Accordingly, it is preferred that the cuts on annular polish pad portions 34*a*, 34*b* be made upwardly diverging by an angular relief, θ ranging between 0° and 60°. Most preferably, the angle of relief, θ, ranges between 10° and 45°. By employing the angular relief mentioned above, a beveled edge is imparted to the opposed edges 64, 66 of annular polish pad portions 34*a*, 34*b*. As can be seen in FIG. 5, it is generally preferred that the radially inner edge of polish pad portion 34*b* and the radially outer edge portion of polish pad portion 34*a* also be beveled to prevent unwanted surface formations on a polished surface of the semiconductor wafer.

Referring again to FIG. 5, semiconductor wafer 80 is shown positioned slightly above the upper surface of the polish pad and slightly below carrier recess 14, for clarity of illustration. In operation, the semiconductor wafer 80 is held captive in recess 14 and is pressed against the polish pad material. In certain instances, the polish pad material may be caused to undergo a certain amount of compression. As can be seen in FIG. 5, this results in the underneath surface of semiconductor wafer 80 being closely spaced with respect to the free end 58 of probe 52. As the wafer carrier is oscillated back and forth in the direction of arrow 82 and is spun about the central axis of wafer carrier 12 (as indicted by arrow 84), portions of the wafer surface travel alternately across the polish pad material and the free end 58 of probe 52, with the underneath surface of semiconductor wafer 80 being monitored continuously on a real-time basis. As will be appreciated, virtually the entire surface of the semiconductor wafer is directly observed with the arrangement of the present invention, and the wafer carrier preferably does not overhang beyond the outer edge of the polish wheel assembly.

Although, in the preferred embodiment, probe 52 operates on an optical basis, the probe could also operate beyond the frequencies of visible light. In addition, two adjacent probes could be employed, one for transmission and one for reception, for example, if desired. The probes could, for example, resemble the probe 52 shown in FIG. 10, except that the 90 degree bend could be replaced by a smaller angled bend, e.g. 45 degrees. In this manner, a pair of oppositely directed mirror-image probes could be mounted for simultaneous operation within channel 42.

As mentioned above, it is preferred that a slurry or some form of fluid material be present between the upper surface of the polish pad material and the bottom surface of semiconductor wafer 80. As the semiconductor wafer 80 passes over the probe 52, it is possible that slurry may become deposited on the probe free end 58. As mentioned above, the probe of the preferred embodiment includes cleaning means which passes a jet of air over the face of the probe, keeping the probe face clean. Also, substantial quantities of slurry may accumulate in recess 32. Accordingly, as shown in FIG. 5, a vent passageway 88 is formed in polish wheel 32 to direct slurry out of recess 42. If desired, a vacuum may be applied adjacent the bottom floor of recess 42 to draw slurry material away. For example, a passageway may be formed between recess 42 and the central portion 44 of polish wheel 32 for convenient conventional coupling to a vacuum source.

As mentioned, it is generally preferred that the radially inner and outer annular portions of the polishing wheel be covered with a single unitary polishing pad which is thereafter divided by cutting in accordance with the above description. Accordingly, it is desired that the probe be removed from recess 42 to facilitate replacement of the polishing pad. As mentioned above, probe 52 is preferably mounted for rotation by controller 54. However, other types of mounting arrangements are also possible. For example, probe 52 could be mounted with the same type of mechanism as a conventional phonograph tone arm in which the free end of the probe is first raised above recess 42 and then swung in a horizontal direction over the top of the polishing wheel. Further, the rotational drive of the controller 54 could be mounted on a conventional elevator or lifting mechanism to raise the probe out of recess 42, before rotation is initiated. Using any of the above arrangements, the probe is rotated out of recess 42 in preparation for the polishing pad replacement. One advantage of the above described arrangements is that the probe remains connected to control circuitry throughout various phases of operation of the polishing wheel.

Figure 8:
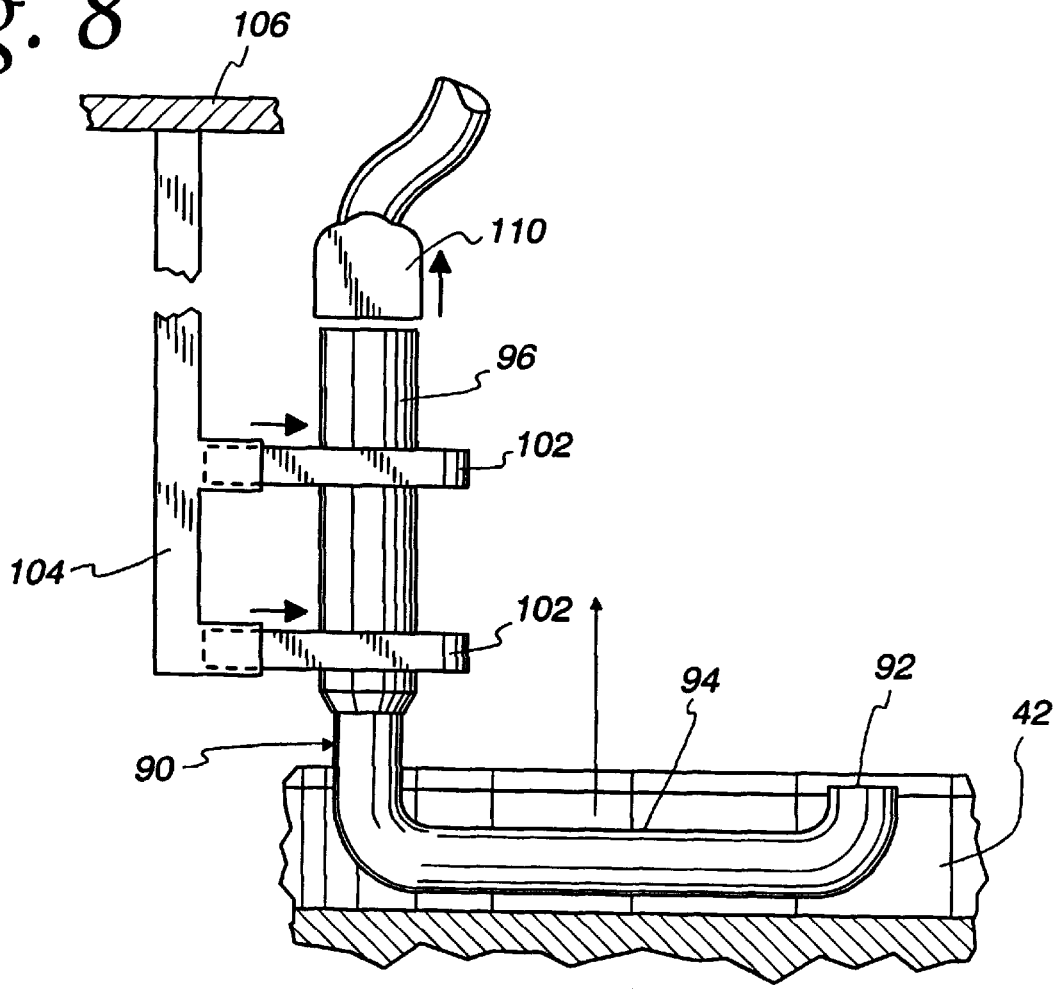
FIG. 8 is a fragmentary cross-sectional view similar to that of FIG. 6, but showing an alternative detection probe arrangement.

Referring now to FIG. 8, an alternative arrangement is shown with a probe 90 having a free end 92 for direct observation of the semiconductor wafer being polished. Free end 42 is carried at one end of a relatively short arcuate portion 94, generally resembling the arcuate portion 60 shown above. Probe 90 includes a second free end 96 comprising a plug portion for slip fit connection to a socket member 110. Probe 90 is mounted on a pair of arms 102, which are removably connected to a hanger 104 suspended from an overlying support member 106. The support member 106 extends upwardly from the table 56 or is otherwise supported from the floor on which the polishing machine is positioned. When service of the polishing wheel is required, separable connector 110 is removed from the free end of probe 96 and arms 102 are removed from hanger 104, allowing the probe 90 to be lifted out of recess 42.

Figure 9:
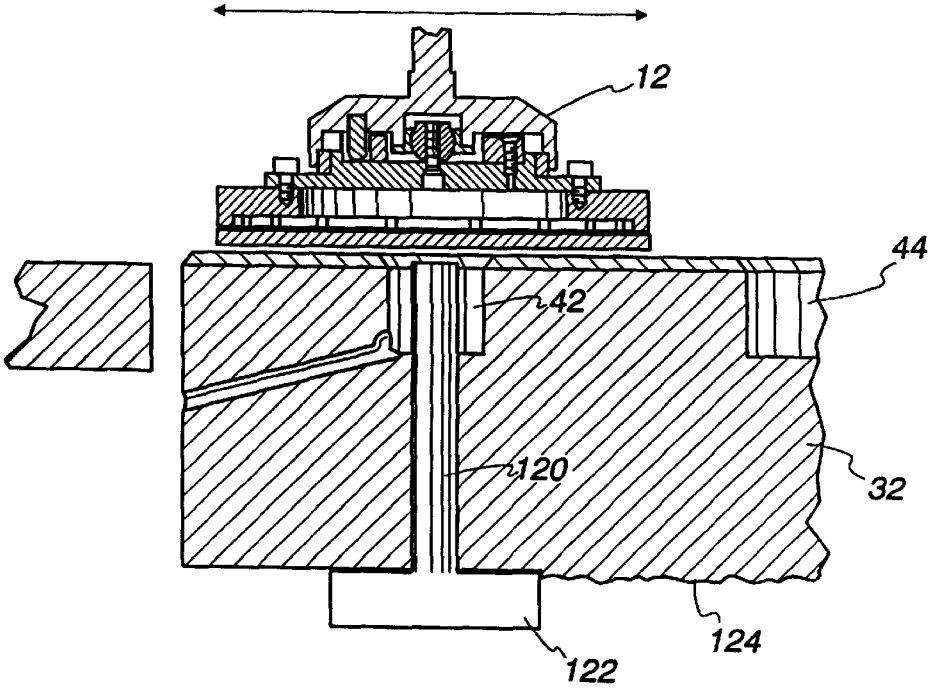
FIG. 9 is a cross-sectional view similar to that of FIG. 5, but showing alternative connection for the detection probe.

Referring now to FIG. 9, an alternative arrangement is shown with probe 120 mounted in polish wheel 132 and having an upper free end positioned within recess 42. The lower end of probe 120 is received within a communications module 122 which converts the probe data into a form which can be carried along conductors 124, which in turn are terminated with a conventional rotational coupling (not shown) adjacent the center of polish wheel 32. If desired, the communications module could take the form of a radio transmitter, so as to eliminate the need for electrical connectors 124 and an associated rotational coupling.

Thus, it can be seen that arrangements are provided for the continuous monitoring of a wafer surface during polishing or other surface operation. Existing commercial probe components can be readily employed with a minimum of modification. If desired, other conventional constructions of optical probes and probes operating in regimes other than those which are optically sensible may be used.

Figure 10:
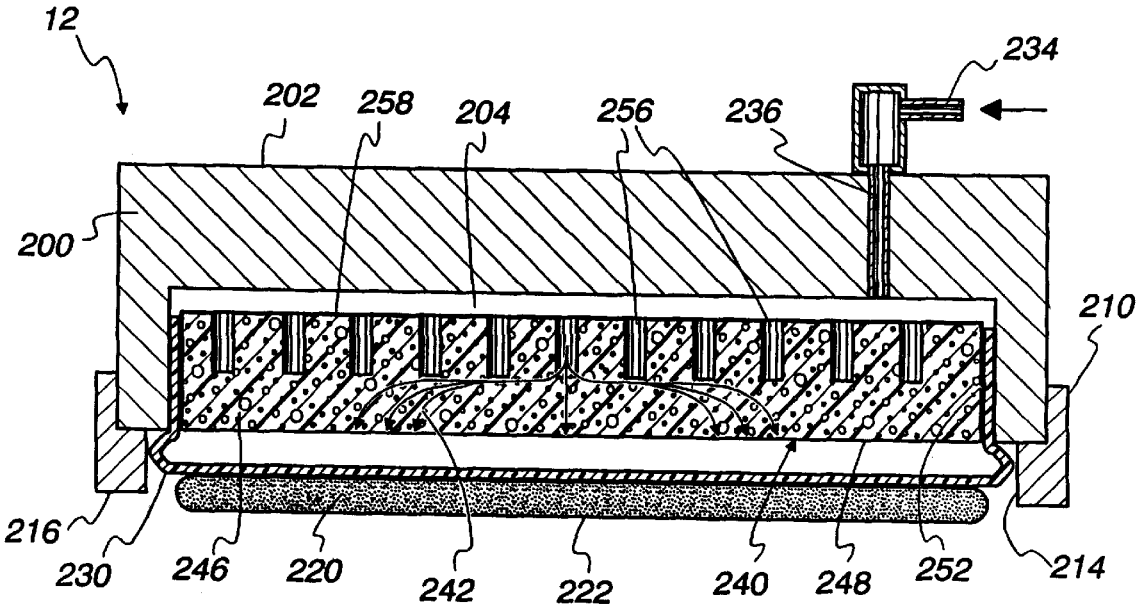
FIG. 10 is a cross-sectional view of the wafer carrier taken along line 10—10 of FIG. 1.

Referring now to FIGS. 10–17, wafer carriers according to the principles of the present invention will be described in greater detail. Referring initially to FIG. 10, wafer carrier 12 includes a backing portion 200 with an upper surface 202 connected in a manner (not shown) to support arm 16, preferably through a conventional gimbal mounting arrangement. Backing member 200 includes a downwardly facing hollow cavity 204 defined, in part, by a generally annular lower wall portion 206. A stepped guide ring 210 is joined to backing member 200 using conventional fastening means. If desired, the guide ring 210 and backing member 200 could be integrally formed one with another. Guide ring 210 includes an annular inner surface 214 and a lower end 216. Guide ring 210 is dimensioned so as to be slightly larger than the semiconductor wafer 220 or other workpiece being processed. Wafer 220 has a lower active surface 222 which contacts the polish wheel assembly during a polishing operation. The semiconductor wafer 220 is pressed against the polish wheel assembly by a flexible bladder 230 which cooperates with backing member 200 to enclose cavity 204 with an air tight closure.

Pressurized fluid (e g., compressed air or other gas, or a liquid) to inflate bladder 230 enters through coupling 234 and travels through passageway 236 formed in backing member 200. The pressurized fluid then enters internal cavity 204 and travels through a pressure balance assembly generally indicated at 240. The pressurized fluid then fills the interior of bladder 230 in the manner indicated by arrows 242.

Pressure balancing assembly 240 comprises a porous media layer 246 of substantially rigid construction. Preferably, porous media layer 246 is sufficiently rigid and has a material composition such that it can be machined by cutting tools, grinding or abrasive lapping. Preferably, porous media layer 246 is machined in a known manner such that its lower surface 248 is planarized to a relatively high tolerance, typically several micro inches for a pad having a radius of several inches. In a preferred embodiment, the porous media layer 246 is made from a 0.125 inch thick sheet of filter material commercially available from POREX TECHNOLOGIES located in the Fairburn, Ga. and sold under the name POREX. The POREX filter material is understood to comprise an expanded porous matrix of plastic, such as high density polyethylene or polypropylene material which is expanded to form a porous structure having, for example, an average mean pore size in the 7–150 micron range with void volumes of 35–50%. In a most preferred embodiment, the porous media layer is made of a sheet of polyethylene POREX material of ⅛ inch thickness. Other types of material may also be used, such as porous ceramic and porous carbon structures. These materials are preferred because of their lateral dispersion characteristics, as well as their mechanical features, being suitable for machining to achieve a high tolerance of global flatness and because of their relative chemical inertness when placed in a Chemical/Mechanical Polishing (CMP) environment.

In the preferred embodiment, the lower surface 248 of porous media layer 246 is machined with a dry abrasive process to achieve the degree of flatness desired, which can be somewhat less than that required for commercial backing pads, for the embodiments shown in FIGS. 10–13, where the bottom surface of the porous media layer is not placed in direct contact with the semiconductor wafer. However, in other embodiments to be described herein, a more intimate "contactless" support is relied upon throughout the ongoing polishing process. As will be seen, in these latter arrangements in which an inflatable bladder is not employed, it is preferred, in certain instances, that the underneath surface of the porous media layer be machined to a flatness comparable to that currently required for CMP backing pads and the like.

Referring again to FIG. 10, a plurality of holes 256 are formed throughout the backside of porous media layer 246 (i.e., the side opposite bottom surface 248) extending a substantial distance, at least 0.031 inch into the interior of a porous media layer which is 0.125 inch thick, a depth sufficient to couple incoming fluid flow to the interior or core of the porous media layer. In a preferred embodiment, a sealing layer 258 is applied to the side of porous media layer 246. Layer 258 preferably comprises the same adhesive material as that used in sealing layer 252, described above.

The porous media layer 246 is preferably secured within cavity 204 by the sealing layer 252 preferably formed of pressure-sealing material, such as a paint or suitable adhesive. Most preferably, the layer 252 comprises conventionally available contact cement, which is sprayed, rolled, or otherwise applied to the outer surface of the porous media layer. Sealing layer 252 could also comprise spark-perforated adhesive tape, an adhesive mesh tape, or may comprise a doctored, discontinuous ("fisheye") layer of adhesive, paint or other coating applied to the outer surface of the porous media layer. Preferably, holes 256 are passed through the sealing layer 258 after the layer has cured sufficiently to allow machining. If the sealing layer 258 is sufficiently discontinuous, and if pressurized fluid can freely pass into the interior of the porous media layer, drilling of holes 256 may be omitted.

As mentioned above, a plurality of holes are formed in the back side of porous media layer 246. In a preferred embodiment, developed for an 8-inch diameter semiconductor wafer, the porous media layer of approximately 8-inch diameter has 16 holes of 0.031 inch diameter equally spaced about two concentric "bolt circles" of 2-inch and 4-inch diameter, respectively. In a more preferred embodiment, eight drilled holes are provided in the back side of the porous media layer grouped about the center of the layer. If desired, the number of drilled holes can be reduced further and, in one embodiment (less preferred because of reliability concerns) a single drilled hole, located approximately at the center of the porous media layer, has been found to offer satisfactory performance. In the various embodiments referred to above, the drilled holes are preferably of approximately 0.031 inch diameter because of hardware requirements unrelated to principles of the present invention. If desired, drilled holes of other diameters, even holes up to one-half inch, can be employed, if desirable.

Fluid pressure entering cavity 204 is directed by holes 256 into the interior of the porous media layer 246, with the sealing layer 258 effectively blocking fluid escape therethrough. As mentioned above, the preferred material for porous media layer 246 comprises an expanded plastic having a controlled average mean pore size and a controlled void volume. Further, the material chosen for the porous media layer has an internal irregular matrix structure so as to avoid relatively straight line flow paths through the interior or core of the porous media layer, while remaining porous in a manner so as to laterally deflect incoming fluid flow as the flow proceeds to the front surface of the porous media layer. Unlike filtration media and various grilles used with filtration media, it is desirable to provide a uniform spacing of entrance holes throughout the surface of the filtration media component. Unlike filtration applications, it is generally preferred when practicing the present invention that the drilled holes formed in the back side of the porous media layer be non-uniformly located with respect to the back side surface, it being generally preferred that the drilled holes be more centrally located with the outer periphery of the back side surface (e.g., the outer 1-inch annulus of an 8-inch porous media layer) remaining free of drilled holes. In an extreme instance, as mentioned above, a single drilled hole can be provided adjacent the center of the porous media layer and, because of the desirable lateral dispersion properties of the preferred porous media layer material, drilled holes located closer to the outer edge of the porous media layer are not required in order to maintain a uniform fluid pressure at the front surface of the porous media layer. Arrows 242 indicate that the porous media layer 246 provides a lateral dispersion of the incoming fluid flow, thus distributing or otherwise balancing fluid pressure across the active (i.e., lower) surface 248 of the porous media layer.

In FIG. 10, the internal volume of bladder 230 is enlarged for clarity of illustration and, in practice, the semiconductor wafer 220 may be located very close to the active surface 248 of the porous media layer. The lower wall portions 216 of guide ring 210 confine the outer periphery of bladder 230. As illustrated in FIG. 10, bladder 230 is shown with an exaggerated lateral bulge for purposes of illustration. In practice, the internal wall 214 of guide ring 210 can be reduced in size so as to more closely correspond to the outer diameter of the porous media layer 246.

Figure 11:
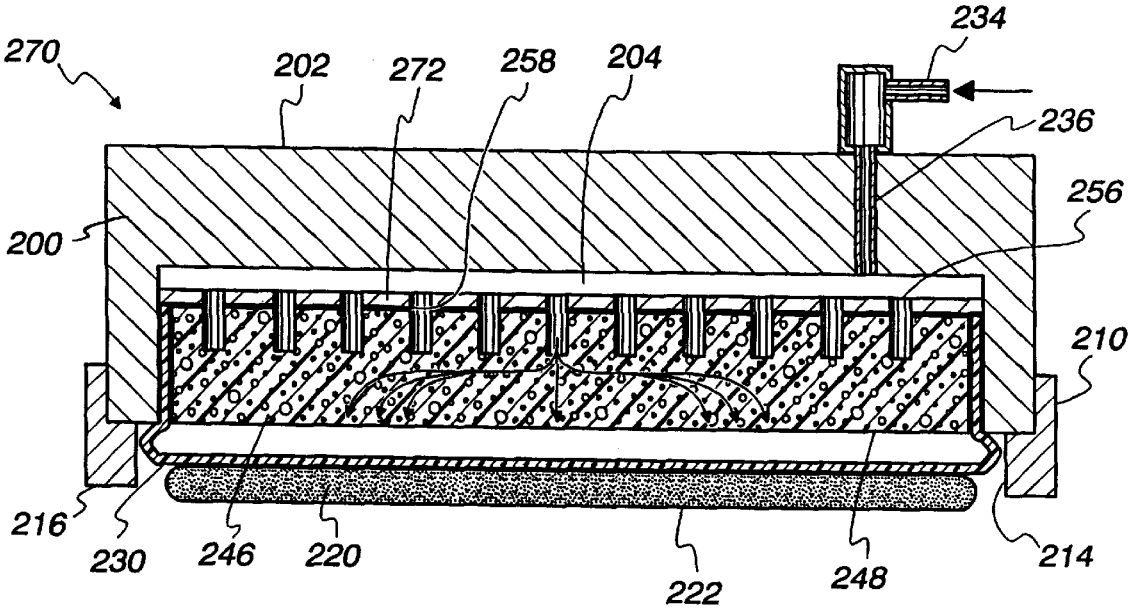
FIG. 11 is a view similar to that of FIG. 10 but showing an alternative wafer carrier constructions.

Referring now to FIG. 11, an alternative carrier assembly is generally indicated at 270. Carrier 270 is substantially identical to carrier assembly 12, except for the introduction of a relatively dense, rigid backing layer 272 of stainless steel, ceramic or a densely filled plastics material. In effect, porous media layer 246 is bonded to backing layer 272 by sealing layer 258 with the resulting assembly thereafter being secured within backing member 200 by sealing layer 252. Backing layer 272 has a material composition and relative thickness so as to add to the rigidity of porous media layer 246 despite lateral forces imparted during polishing.

Figure 12:
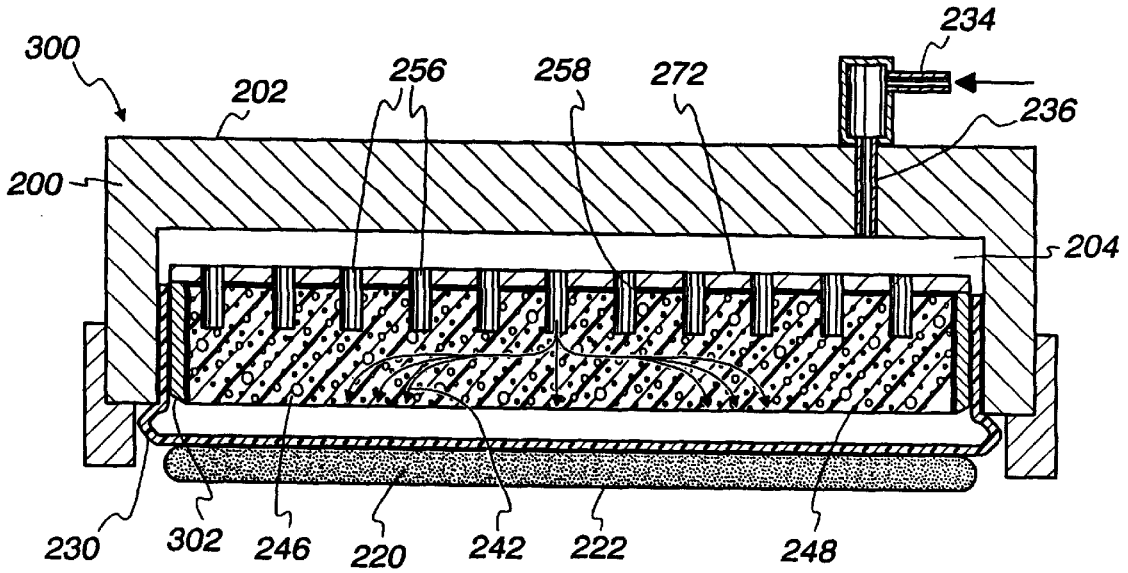
FIG. 12 is a cross-sectional view showing another alternative construction of a wafer carrier.

Turning now to FIG. 12, an alternative carrier assembly is generally indicated at 300 and is substantially identical to carrier assembly 270 described above with reference to FIG. 11, except for an outer annular wall 302 similar in construction to backing layer 272. As with backing layer 272, outer annular wall 302 has a material composition and relative thickness chosen so as to enhance the rigidity of porous media layer 246 and, if desired, outer annular wall 302 can be integrally formed with backing layer 272. Preferably, outer annular wall 302 is secured to the interior surface of backing member 200 with a suitable adhesive (not shown). With backing layer 272 and outer wall 302, a separate rigidifying structure can be provided for porous media layer 246 using a more easily formed material than that of backing member 200. The backing layer 272 and outer wall 302 can be more conveniently fitted to porous media layer 246 on a bench or other remote site thereby simplifying the assembly process. Further, the porous media layer 246 can be more readily removed from backing member 200, if a replacement of the porous media layer should be required.

A sealing layer 252 joins the outer periphery of porous media layer 246 to the lower portion of body 312, whereas sealing layer 258 joins the remote, back surface of porous media layer 246 to the body member internal wall 322. The arrangement shown in FIG. 12 provides an enhanced support adding to the rigidity of porous media layer 246 so as to adequately withstand distorting forces transmitted through the porous media layer.

Figure 13:
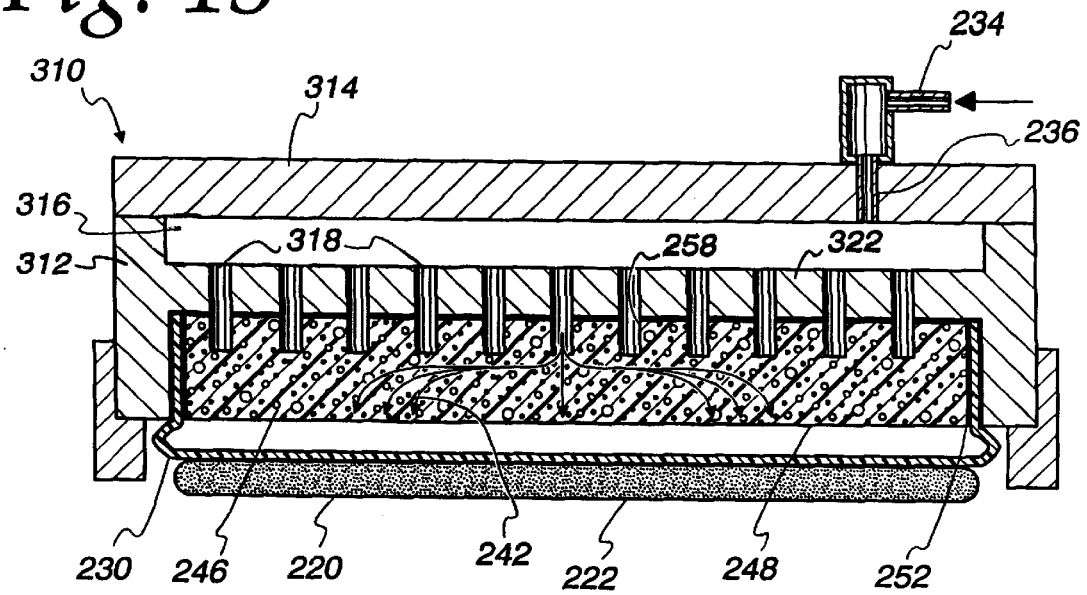
FIG. 13 is a cross-sectional view of a different wafer carrier construction.

Turning now to FIG. 13, an alternative carrier assembly is generally indicated at 310. A two-piece backing member comprises a body portion 312 and a cover-like end portion 314 joined together so as to provide an internal cavity 316, communicating with holes 318 extending into the interior of porous media layer 246, in the manner described above. As can be seen in FIG. 13, the holes 318 not only pass through sealing layer 258, but also through internal wall 322. Also, as in the preceding embodiments, the holes 318 extend a substantial distance into the interior of porous media layer 246, at least 0.031 inch for a porous media layer of 0.125 inch thickness. The holes 318 are arranged, preferably in regular grid-like spacing, adjacent the center of the back surface of porous media layer 246. The holes 318 are of relatively small diameter (0.031 inch) compared to the diameter (8 inches) of porous media layer 246. For example, in one embodiment a relatively small number of equally spaced holes, between 8 and 16, are formed in a porous media layer of 8 inch diameter.

Air flow passing through holes 318 remains substantially collimated upon entry into the lateral dispersion matrix of layer 246. As in the preceding embodiments, the function of holes 318 is to ensure the introduction of air flow throughout the entire interior of the porous media layer and any collimation of the air flow entering the porous media layer is immediately disrupted once the airflow enters the porous media layer 246 which provides a lateral dispersion to a substantial component of the air flow passing through each hole 318, as indicated by arrows 242. As with the proceeding embodiments of FIGS. 10–12, air flow exiting the lower end 248 of the porous media layer inflates the flexible bladder 230 in a uniform manner to ensure that a uniform air pressure is applied to the back side of wafer 220 so that, in turn, uniform pressure is applied to the front side 222, during a polishing operation.

Even with substantial down force during a polishing operation, the porous media layer 246 remains firmly attached to the relatively rigid body portion 312 with shape distortions of the relatively lightweight porous media layer being avoided.

In the preceding arrangements illustrated in FIGS. 10–13, a resilient inflatable bladder applies polishing pressure or down force to the wafer 220. Turning now to FIGS. 14–17, it will be seen that the inflatable bladder has been omitted, with polishing down force applied to wafer 220 being provided by the fluid flow passing through porous media layer 246.

Figure 14:
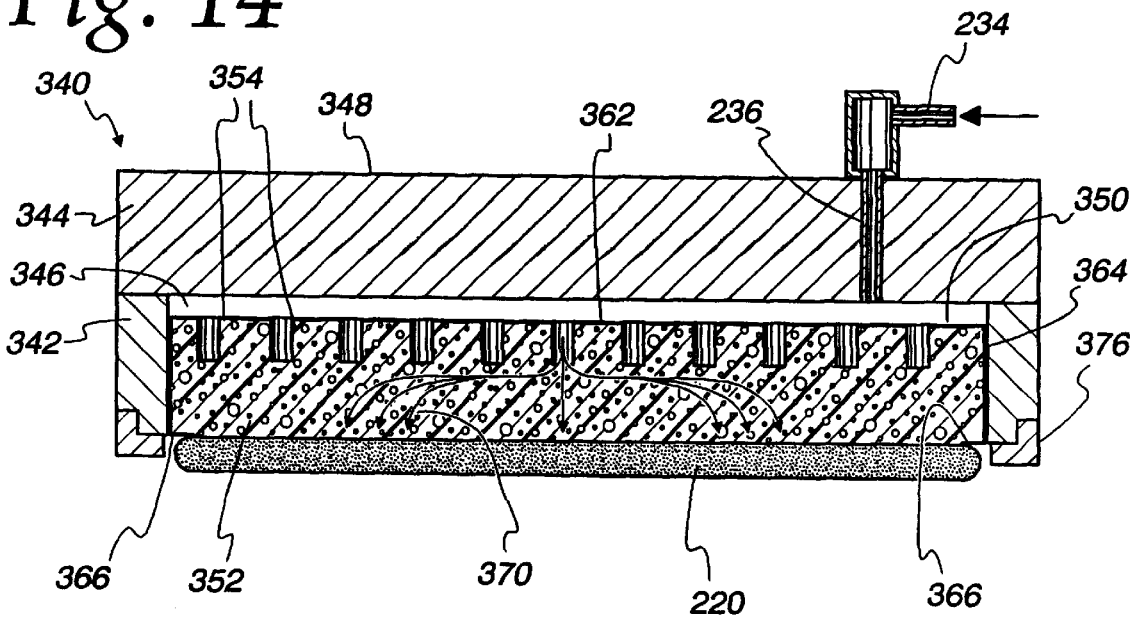
FIG. 14 is a cross-sectional view of a wafer carrier construction which does not employ an inflatable bladder.

Referring now to FIG. 14, the wafer carrier assembly, generally indicated at 340, includes a two-piece backing member including a generally annular body member 342 and a cover member 344. Together, the body member 342 and cover 344 cooperate to define a hollow interior cavity 346 in air fitting 234 secured adjacent the outer free end 348 of cover 344 to communicate with internal passageway 236 so as to enter internal cavity 346. A pressure balancing assembly is generally indicated at 350. The pressure balancing assembly 350 includes a porous media layer 352, preferably formed of POREX material, which, as mentioned above, is comprised of an expanded plastic matrix and which has a generally uniform internal construction so as to impart a uniform lateral dispersion to air flow entering holes 354 formed in the back side of the porous media layer. The lateral dispersion provided by the pressure balance assembly eliminates doming of the wafer being polished and lateral forces on the wafer which would otherwise dislodge the wafer from the wafer carrier.

If desired, the porous media layer 352 can be comprised of other readily available materials, such as porous ceramic or porous carbon block. It is important that the porous media layer have a relatively rigid internal structure which is maintained as the lower surface (facing the wafer 220) undergoes machining for flatness. In a preferred embodiment, the porous media layer is made of commercially available POREX material which has been cut to size with the bottom surface lapped with a fixed dry abrasive material to achieve a flatness comparable to that of commercial semiconductor wafer backing pads (e.g., a flatness of several parts in a million throughout the entire surface of the porous media layer). As can be seen in FIG. 14, the outer surface of porous media layer 352 is partly surrounded with a sealing layer 362. As with the preceding embodiments, the sealing layer 362 covers the back side of the porous media layer (i.e., that side facing the cavity 346). The sealing layer 362 preferably comprises a coating on the outer surface of the porous media layer material and most preferably comprises a cement or other adhesive which adhesively bonds the outer annular side of the porous media layer to the body member 342, as indicated by reference numeral 364.

Referring to the lower portion of FIG. 14, a portion 366 of the sealing layer 362 covers the front surface of the porous media layer 352, facing the wafer 220. Sealing portion 366 covers the outermost peripheral portion of the front surface of porous media layer 352 so as to contact the outer periphery of the "back" surface of semiconductor wafer 220 (i.e., the upper surface as shown in FIG. 14). The portion 366 of the sealing layer is preferably suitable for forming a seal when pressed against the upper wafer surface, as when down force is applied to the wafer carrier assembly. In the absence of fluid pressure applied through fitting 234 and holes 354 to the porous media layer, the front surface of the porous media layer (the lower surface of porous layer 352 in FIG. 14 facing wafer 220) is placed in direct contact with the wafer 220. However, with the application of fluid pressure to the porous media layer, a small but continuously maintained air cushion separates the opposed surfaces of the porous media layer and the wafer 220.

As described above, the internal structure of the porous media layer 352 promotes a lateral dispersion of fluid flow passing through holes 354 in the manner indicated by arrows 370 in FIG. 14. As contemplated herein, the term "lateral dispersion" refers to a direction of fluid flow away from a normal direction to the wafer (or porous media layer) major surface. The lateral dispersion of the flow helps equalize fluid pressure at the interface between wafer 220 and the porous media layer 352. In effect, with the introduction of fluid pressure into the porous media layer, the bottom surface of the porous media layer as shown in FIG. 14 functions as an air-bearing surface. Under these conditions, the wafer 220 is free to move in lateral directions (i.e., in directions along the plane of its major surfaces). Due to the low friction of the air-bearing surface created, and imbalances in fluid pressure applied to wafer 220, result in a near instantaneous lateral dislocation of the wafer. If the wafer should move past the portion 366 of sealing layer 362, fluid pressure would be allowed to escape and the air-bearing relationship would be immediately lost, unless sufficient air flow and pressure is maintained through the porous media layer, so that the wafer carrier in effect functions in a manner similar to a "hovercraft".

In many applications, such volume and pressure of fluid flow would substantially disturb the slurry underneath wafer 220, i.e., between wafer 220 and the polish surface against which the wafer is pressed during a polishing operation. Optional guide rings 376 may be employed for lateral containment of the wafer 220 with respect to the active front surface of porous media layer 352 (i.e., the lower surface in FIG. 14). Certain polishing operations involve an oscillating or other sideways movement of the wafer carrier during a polishing operation. Thus, the polishing motion of the wafer carrier during a polishing operation may in itself be sufficient to cause a lateral dislocation of the wafer with respect to the porous media layer, considering the frictional forces developed between the wafer and the polish pad.

Figure 15:
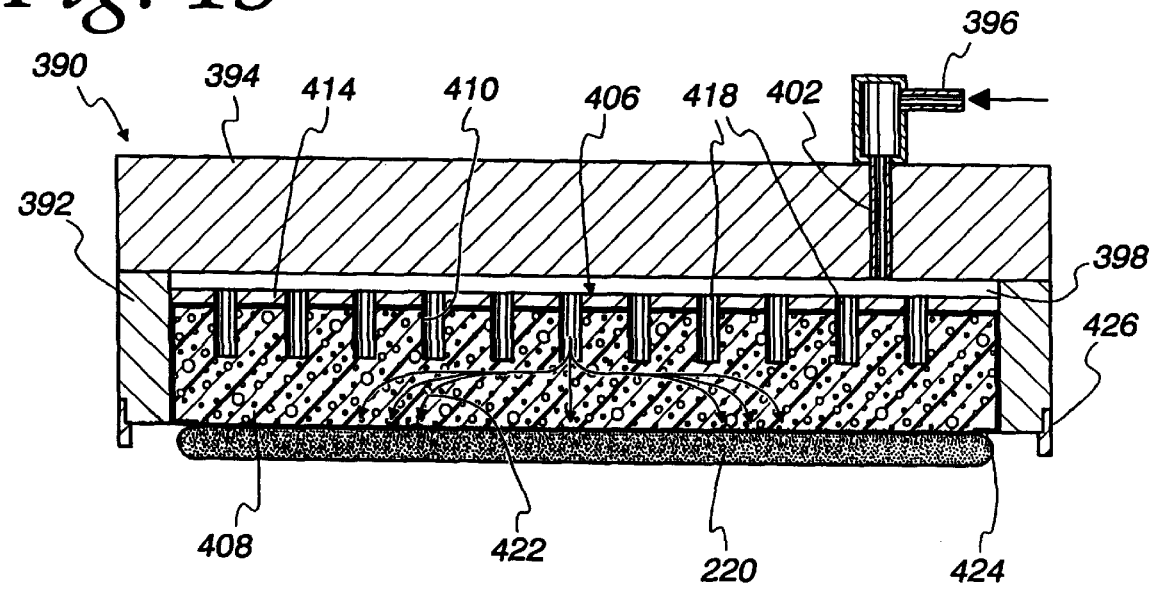
FIG. 15 is a cross-sectional view similar to that of FIG. 14 but showing a different wafer carrier construction.

Turning now to FIG. 15, a wafer carrier is generally indicated at 390 and includes a backing plate comprised of an annular body 392 and a cover portion 294. A pressure fitting 396 couples fluid pressure to cavity 398 through passageway 402. Cavity 398 is formed by the cooperation of body member 392, cover 394 and a pressure balance assembly generally indicated at 406. The pressure balance assembly includes a porous media layer 408, a substantial portion of its outer surface being covered by a sealing layer 410 of a cement or other adhesive or a paint or varnish or coating of latex or other material. As with the embodiment illustrated in FIG. 14, the sealing layer 410 extends to the periphery of the active or front surface of the porous media layer 408 (i.e., that surface facing wafer 220). A backing layer 414 covers the back surface of porous media layer 408 (i.e., that surface facing internal cavity 398). Backing layer 414 is preferably of a rigid material, such as stainless steel, which adds to the rigidity of the porous media layer. Backing layer 414 is secured to the porous media layer by sealing layer 410. A plurality of holes 418 pass through backing layer 414 and sealing layer 410, so as to protrude into porous media layer 408.

In the preferred embodiment shown in FIG. 15, porous media layer 408 preferably comprises commercially available POREX material, chosen because of its ability to introduce lateral dispersion and to air flow entering through holes 418, as indicated by arrows 422. As mentioned above with regard to FIG. 14, lateral dispersion of fluid pressure applied to holes 418 balances the fluid pressure across the active surface (i.e., the lower surface of FIG. 15) of the porous media layer 408. The peripheral annular portion 424 of sealing layer 410 provides a pressure-tight seal with wafer 220 as down force is applied to the wafer. In the preferred embodiment, fluid pressure is applied through fitting 396 so as to create a slight separation between the lower surface of porous media layer 408 and the upper surface of wafer 220 so as to provide a "contactless" backing of the wafer during the polishing operation. If desired, an optional guide ring 426 can be provided to surround the peripheral edge of wafer 220.

Figure 16:
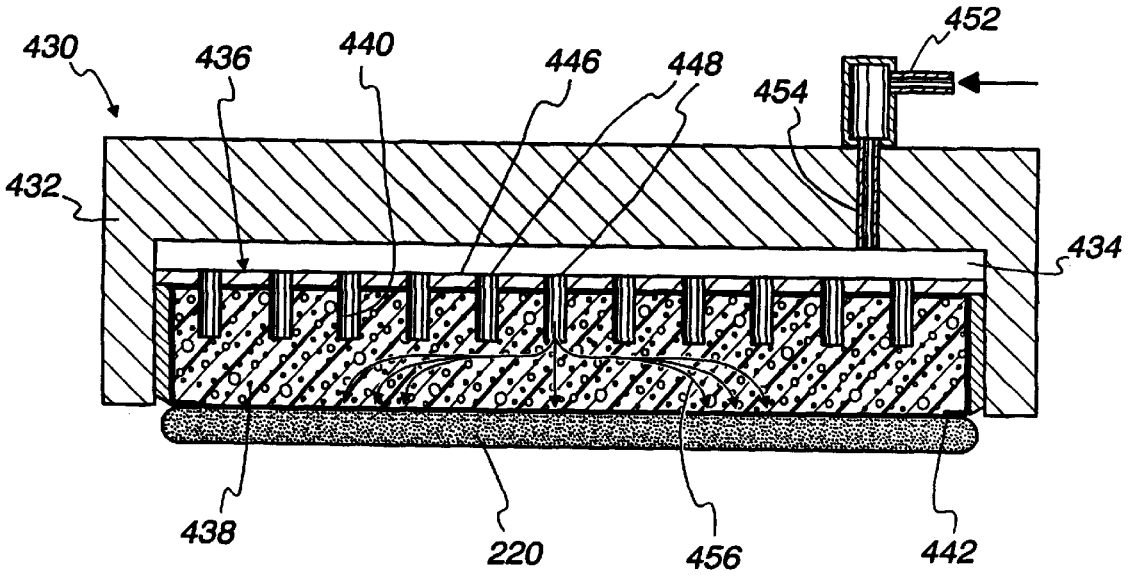
FIG. 16 is a view similar to that of FIG. 14 but showing yet another construction of a wafer carrier.

Referring now to FIG. 16, wafer carrier is generally indicated at 430 and includes a backing member 432 defining an internal cavity 434. A pressure balance assembly generally indicated at 436 includes a porous media layer 438 partly surrounded by a sealing layer 440, including a peripheral portion 442 at its active (i.e., lower) surface facing wafer 220. A rigid backing layer 446 surrounds the back side (i.e., upper surface in FIG. 16) and annular side surface of porous media layer 438. The rigid backing 446 is preferably formed of stainless steel or other relatively rigid material so as to contribute to the rigidity of the porous media layer 438. A plurality of holes 448 pass through backing 446 and sealing layer 440 so as to enter into the interior of porous media layer 438. Holes 448 provide communication of a pressurized fluid introduced at fitting 452 and passing through passageway 454 to interior portions of porous media layer 438 assuring fluid injection into the interior of the porous media layer. In the preferred embodiment, porous media layer 438 is made of POREX material which, as described above, provides lateral dispersion of the fluid, as indicated by arrows 456. As with the preceding embodiments, it is generally preferred that the holes formed in the porous media layer are arranged across the rear major surface of the porous media layer so as to provide injection of fluid throughout the substantial entirety of the porous media. The ability of the porous media layer to laterally disperse the incoming pressurized fluid assures a uniform pressure at the active (i.e., lower) surface of the porous media layer, which faces wafer 220. In operation, the flow rate and pressure of fluid entering fitting 452 is maintained so as to acquire and sustain a slight separation between the wafer 220 and porous media layer 438 so as to form an air-bearing between the two. Annular portion 442 of the sealing layer helps maintain the air-bearing feature, by providing sealing engagement between the porous media layer and the wafer 220. The backing 446 may be made of two parts, as illustrated in FIG. 16, or may be made of a monolithic construction resembling a container cap or lid. Rigid backing 446 helps to maintain the three-dimensional shape of the porous media layer, despite the application of substantial down force and lateral friction forces to the porous media layer.

Figure 17:
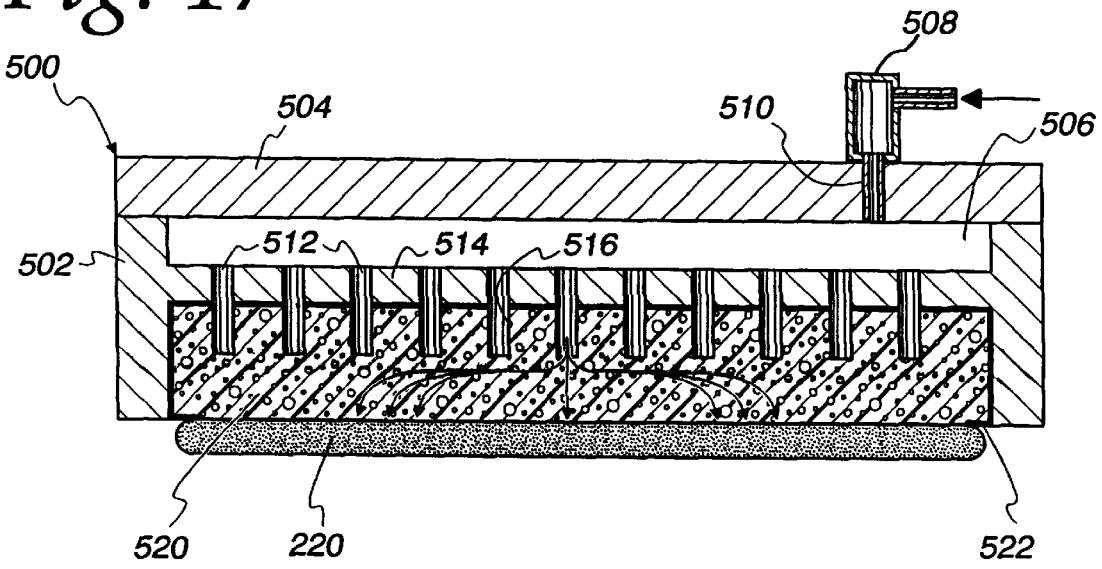
FIG. 17 is a cross-sectional view showing another alternative construction of a wafer carrier.

Turning now to FIG. 17, an alternative arrangement for providing added rigidity to the porous media layer is provided in the wafer carrier generally indicated at 500. A backing member is comprised of first and second portions 502, 504. The upper part of backing member 502 cooperates with backing member 504 to form an internal cavity 506. Pressurized fluid enters cavity 506 via fitting 508 and passageway 510. The pressurized fluid travels through holes 512 which pass through an internal wall 514 of backing member 502, a sealing layer 516 and enters into the rear portion (i.e., the upper portion) of porous media layer 520. Portion 522 of sealing layer 516 extends over the lower surface of the porous media layer, so as to contact the wafer 220, forming a sealing engagement therewith as down force is applied to the wafer carrier. In a preferred embodiment, porous media layer 520 is comprised of commercially available POREX material so as to impart a lateral dispersion to incoming pressure flow entering the porous media layer through holes 512. As in the preceding arrangements illustrated in FIGS. 14–16, pressure flow is maintained so as to provide a slight separation between wafer 220 and porous media layer 520 during a wafer polishing operation so as to provide an air bearing between the two members. If laterally directed dislocation forces are experienced, it may be desirable to provide a guide ring surrounding the lateral periphery of wafer 220. In the embodiment illustrated in FIG. 17, the lower ends of backing part 502 are lowered so as to cover at least a portion of the lateral angular surface of wafer 220.

In the arrangements described above with reference to FIGS. 14–17, it is generally preferred that a slight separation is formed between the porous media layer and the wafer undergoing polishing. However, the thickness of such separation is relatively small and, accordingly, it has been found desirable to impart a highly accurate surface flatness to the lower surface of the porous media layer. As mentioned above, such flatness is approximately the same as that required for commercial polishing backing films which is also approximately the same flatness as that required for the finished surfaces of semiconductor wafers undergoing a polishing operation.

Assuming the various backing members illustrated in FIGS. 14–17 are formed of stainless steel or other suitably dense rigid material, preparation of the pressure balancing assemblies can be conveniently carried out using commercial dry abrasive lapping techniques. For example, in FIG. 14, guide ring 376 can, initially, be omitted until the desired flatness is imparted to the porous media layer 352. If desired, the porous media layer 352 can be mounted within annular body member 342 by sealing layer 364. The lower surface of the incomplete wafer carrier can then be dressed using dry abrasive lapping techniques with substantially all of the material removal being experienced by the porous media layer as opposed to the backing member 342. The backing layer 342 can then be used as a guide to aid in the removal of material to introduce the desired flatness to the lower surface of porous media layer 352. The guide ring 376 can then be installed after the desired flatness has been attained. Alternatively, the pressure balance assembly can be completely formed beforehand with outer coatings 362, 364 and 366 being applied and holes 354 being formed.

The pressure balance assembly is then treated in a dry lapping operation to impart the desired flatness to the lower side of porous media layer 352. Thereafter, the pressure balance assembly can be mounted within the backing member, as a completed sub-assembly. The same fabrication techniques can be employed with wafer carrier 390 illustrated in FIG. 15. As can be seen, the pressure balance assembly 406 is made to protrude somewhat below the lower end of backing member 392. Accordingly, if the pressure balance assembly is secured within the backing member before planarization, contact of the abrasive lapping wheel with the lower end of backing part 392 is avoided. In FIGS. 16 and 17, the surrounding backing members protrude below the lower surface of the pressure balance assemblies and, accordingly, it is desirable that the pressure balance assemblies be treated beforehand to achieve the desired flatness on the lower surfaces of their porous media layers.

In the arrangements of FIGS. 14,15 and 17, holes may be formed in the back side of the respective porous media layers by removing the cover portions of their respective backing members, if desired. Alternatively, the holes may be formed in the porous media layers before their joinder to the backing members, as is mandatory in the arrangement shown in FIG. 16. In the arrangement shown in FIG. 17, the holes are also made to pass through an internal wall 514 of backing member 502. In order to achieve an optimal rigidity for the porous media layer, the internal wall 514 is relatively massive in comparison to the backing layers of FIGS. 15 and 16. Accordingly, it is generally preferred that the internal wall 514 be separately treated in a drilling operation or the like to form holes therethrough. It is preferred, thereafter, that the pressure balance assembly be completed, and its lower surface planarized, before being installed within the lower backing member 502. Thereafter, the holes in internal wall 514 are re-drilled to extend through the sealing layer 516 and into the porous media layer, completing the arrangement illustrated in FIG. 17. Thereafter, cover 504 is fitted to backing member 502.

Regardless of the particular assembly method employed, it can be seen that the wafer carriers, herein, afford an economical construction using conventional well developed commercial techniques without requiring specialized equipment or skills. Further, replacement of components necessitated by prolonged use of the wafer carries can be readily carried out to the advantageous constructions, described herein.

As will be appreciated by those skilled in the art, the polishing table described above with reference to FIGS. 1–9 is particularly suited for use with the wafer carriers described herein with reference to FIGS. 10–17, since edge control of the air-bearing is continuously maintained during a polishing operation. Further, the advantages of direct observation end point detection can continue to be enjoyed even with air-bearing or "contactless" wafer carriers. The polishing table described herein provides the special handling required to retain the air-bearing feature during the polishing operation, thus preventing print-through and other undesirable effects resulting from a direct contact of the wafer carrier with the wafer during the polishing operation.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A wafer carrier for polishing a surface of a semiconductor wafer, comprising:

a backing member defining a recess;

a pressure balance assembly received in said recess and including a porous media layer having a core portion surrounded by a side wall extending between spaced-apart front and back opposed major surfaces;

a fluid-impermeable sealant layer on said back surface;

at least one hole communicating with said recess, defined by said pressure balance assembly and extending through said sealant layer and the back surface of the core portion of said porous media layer; and fluid coupling means coupling an external fluid source to said recess to thereby introduce a fluid into the core portion of said porous media layer through said at least one hole, with said porous media layer laterally dispersing fluid introduced through said at least one hole, so that said fluid travels toward said front surface in directions non-normal to said front surface so as to balance the fluid flow across said front surface.

2. The arrangement of claim 1 wherein said fluid coupling means comprises a passageway extending through said backing member extending to said recess.

3. The arrangement of claim 1 wherein said porous media layer is formed of expanded plastic material having a defined pore size throughout said porous media layer core.

4. The arrangement of claim 3 wherein said porous media comprises POREX material.

5. The arrangement of claim 1 further comprising a backing plate joined to the back surface of said porous media layer to provide rigid support for the porous media layer.

6. The arrangement of claim 5 wherein said backing plate is secured to the back surface of said porous media layer by said fluid impermeable sealant.

7. The arrangement of claims 6 wherein said fluid impermeable sealant comprises an adhesive coating.

8. The arrangement of claim 1 wherein said fluid impermeable sealant covers the side wall of said porous media layer.

9. The arrangement of claim 1 further comprising an inflatable bladder covering the front surface of said porous media layer and secured to said backing member so as to form a fluid-tight containment of said fluid.

10. The arrangement of claim 9 wherein said inflatable bladder is secured to said backing member so as to form a fluid-tight containment of said fluid.

11. The arrangement of claim 9 wherein said inflatable bladder is secured to said pressure balance assembly so as to form a fluid-tight containment of said fluid.

12. The arrangement of claim 1 wherein said porous media layer has a predetermined diameter, the arrangement further comprising a plurality of holes communicating with said recess, defined by said pressure balance assembly and extending through radially central portions of said sealant layer into the core portion of said porous media layer, said plurality of holes being spaced at least 12% of the diameter of the porous media layer away from the side wall of the porous media layer.

13. An arrangement for polishing a surface of a semiconductor wafer, comprising:

a support table having a central axis and an upper, support surface for engaging the surface of the semiconductor wafer to provide support for the semiconductor wafer;

an annular recess defined by the support table, extending to the support surface so as to form an opening therein, between two annular support surface portions;

a polish pad covering the support surface of the support table;

a monitoring probe disposed in the recess and having a free end portion adjacent the semiconductor wafer to monitor the semiconductor wafer surface without interfering with the semiconductor wafer surface;

table rotating means for rotating the support table about the central axis, with the monitoring probe supported against rotation with the table; and a wafer carrier suspended above said polish pad, to press the semiconductor wafer surface against the polish pad, comprising:

a backing member defining a recess;

a pressure balance assembly received in said recess and including a porous media layer having a core portion surrounded by a side wall extending between spaced-apart front and back opposed major surfaces;

a fluid-impermeable sealant layer on said back surface;

at least one hole communicating with said recess, defined by said pressure balance assembly and extending through said sealant layer into the core portion of said porous media layer; and fluid coupling means coupling an external fluid source to said recess to thereby introduce said fluid into the core portion of said porous media layer through said at least one hole, with said porous media layer laterally dispersing fluid through said at least one hole toward said front surface in directions non-normal to said front surface so as to balance the fluid flow across said front surface.

14. The arrangement of claim 13 further comprising mounting means for mounting the probe for movement into and out of said recess.

15. The arrangement of claim 14 wherein said mounting means includes rotational mounting means for mounting the probe for rotational movement into and out of said recess.

16. The arrangement of claim 13 wherein said polish pad comprises a single unitary polish pad covering substantially the entire support surface, the single unitary polish pad being divided into two portions to expose the recess.

17. The arrangement of claim 13 wherein said wafer carrier moves the semiconductor wafer back and forth across said annular recess to move the semiconductor wafer surface across said monitoring probe.

* * * * *